US010635042B2

(12) United States Patent
Morishita

(10) Patent No.: US 10,635,042 B2
(45) Date of Patent: Apr. 28, 2020

(54) IMAGE FORMING APPARATUS

(71) Applicant: KYOCERA Document Solutions Inc., Osaka (JP)

(72) Inventor: Hiroki Morishita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/420,260

(22) Filed: May 23, 2019

(65) Prior Publication Data

US 2019/0361388 A1 Nov. 28, 2019

(30) Foreign Application Priority Data

May 24, 2018 (JP) ..... 2018-099683

(51) Int. Cl.
*G03G 21/16* (2006.01)
*G03G 15/16* (2006.01)

(52) U.S. Cl.
CPC ..... *G03G 21/1647* (2013.01); *G03G 15/16* (2013.01); *G03G 21/1619* (2013.01); *G03G 21/1633* (2013.01); *G03G 2221/1642* (2013.01); *G03G 2221/1654* (2013.01)

(58) Field of Classification Search
None
See application file for complete search history.

(56) References Cited

U.S. PATENT DOCUMENTS

| | | | | |
|---|---|---|---|---|
| 7,269,378 | B2 | 9/2007 | Baek et al. | |
| 7,341,387 | B2 * | 3/2008 | Nishimura | G03G 15/6552 399/363 |
| 2005/0084290 | A1 | 4/2005 | Baek et al. | |
| 2018/0210370 | A1 * | 7/2018 | Wakimoto | G03G 21/1864 |

FOREIGN PATENT DOCUMENTS

| | | | |
|---|---|---|---|
| JP | 2005-122137 | A | 5/2005 |

* cited by examiner

*Primary Examiner* — Roy Y Yi
(74) *Attorney, Agent, or Firm* — Studebaker & Brackett PC

(57) ABSTRACT

An image forming apparatus includes a main body, an upper unit, and a moving mechanism. The main body includes an image forming section. The image forming section forms an image on paper. The upper unit is disposed in an upper portion of the main body. The moving mechanism moves the upper unit to a first position and to a second position. The first position of the upper unit is above a position of the image forming section in the upper portion of the main body. The second position of the upper unit is in the upper portion of the main body and is different from the first position.

6 Claims, 9 Drawing Sheets

IMAGE FORMING APPARATUS

INCORPORATION BY REFERENCE

The present application claims priority under 35 U.S.C. § 119 to Japanese Patent Application No. 2018-099683, filed on May 24, 2018. The contents of this application are incorporated herein by reference in their entirety.

BACKGROUND

The present disclosure relates to an image forming apparatus.

A generally known image forming apparatus is adapted to a detachable transfer unit. An example of such an image forming apparatus includes a transfer unit attachment device for attaching and detaching the transfer unit. The transfer unit attachment device includes a slope guide rail. The transfer unit is moved along the guide rail to be attached to or detached from the image forming apparatus.

SUMMARY

An image forming apparatus according to an aspect of the present disclosure includes a main body, an upper unit, and a moving mechanism. The main body includes an image forming section. The image forming section forms an image on paper. The upper unit is disposed in an upper portion of the main body. The moving mechanism moves the upper unit to a first position and to a second position. The first position of the upper unit is above a position of the image forming section in the upper portion of the main body. The second position of the upper unit is in the upper portion of the main body and is different from the first position.

DETAILED DESCRIPTION

Figure 1:
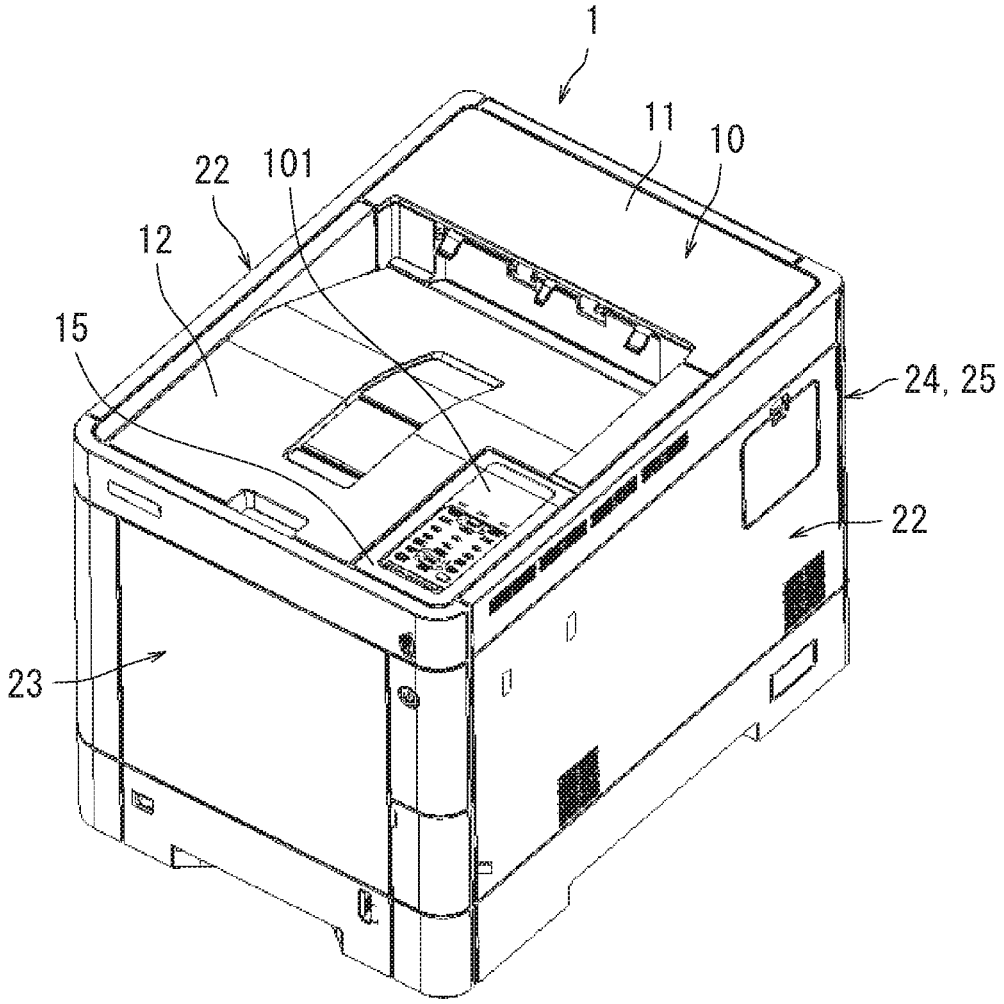
FIG. 1 is a diagram illustrating an image forming apparatus according to an embodiment of the present disclosure.

The following describes an embodiment of the present disclosure with reference to the accompanying drawings. Note that elements that are the same or equivalent are indicated by the same reference signs in the drawings and description thereof is not repeated.

Figure 2:
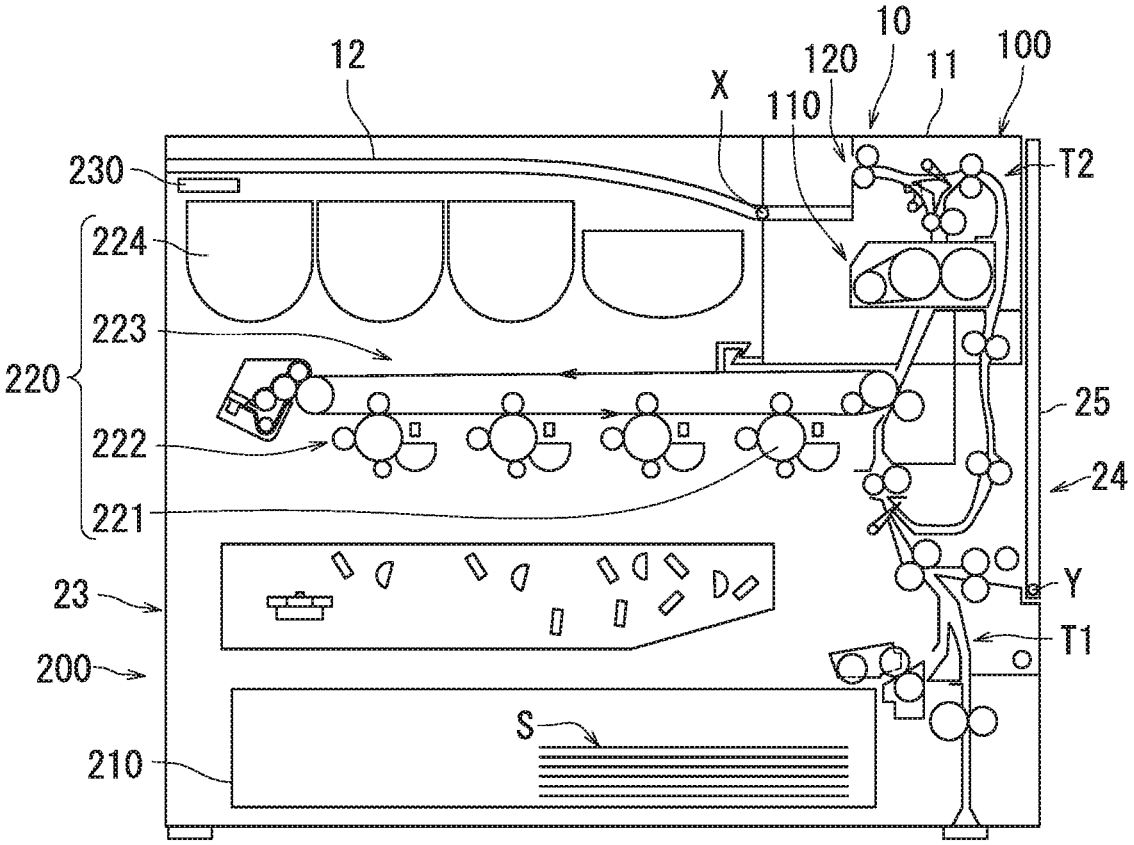
FIG. 2 is a cross-sectional view schematically illustrating the image forming apparatus according to the embodiment of the present disclosure.

The following describes an image forming apparatus 1 according to the embodiment of the present disclosure with reference to FIGS. 1 and 2. FIG. 1 illustrates the image forming apparatus 1 according to the embodiment of the present disclosure. FIG. 2 is a cross-sectional view schematically illustrating the image forming apparatus 1 according to the embodiment of the present disclosure. As illustrated in FIG. 1, the image forming apparatus 1 includes a plurality of exterior members.

The exterior members constitute an exterior of the image forming apparatus 1. The exterior members include a top panel 10, side panels 22, a front panel 23, and a back panel 24.

The top panel 10 closes the top of the image forming apparatus 1. The top panel 10 includes covers. Specifically, the covers include a first cover 11, a second cover 12, and a third cover 15.

The first cover 11 closes a top portion of the image forming apparatus 1. The first cover 11 is located in the vicinity of the back panel 24. The top portion closed by the first cover 11 is a top portion of the image forming apparatus 1 that is adjacent to the back panel 24.

The second cover 12 closes a top portion of the image forming apparatus 1. The top portion closed by the second cover 12 is different from the top portion of the image forming apparatus 1 closed by the first cover 11. The second cover 12 is located next to the first cover 11. The second cover 12 is located in the vicinity of the front panel 23.

The second cover 12 has a flat section and a slope section. The flat section of the second cover 12 is located adjacent to the front panel 23. The slope section of the second cover 12 is located adjacent to the first cover 11. The slope section slopes toward the inside of the image forming apparatus 1.

A sheet S is placed on the second cover 12. Specifically, the sheet S is ejected out of the image forming apparatus 1, and then placed on an upper surface of the second cover 12.

The third cover 15 closes a top portion of the image forming apparatus 1. The top portion closed by the third cover 15 is different from the top portion of the image forming apparatus 1 closed by the first cover 11. The top portion closed by the third cover 15 is different from the top portion of the image forming apparatus 1 closed by the second cover 12. The third cover 15 is located next to the second cover 12. The third cover 15 is located in the vicinity of the front panel 23. The third cover 15 is located in the vicinity of the flat section of the second cover 12.

The side panels 22 close the sides of the image forming apparatus 1. The front panel 23 closes the front of the image forming apparatus 1. The back panel 24 closes the back of the image forming apparatus 1. The back panel 24 includes a back cover 25.

The following describes the image forming apparatus 1 in detail with reference to FIGS. 1 and 2. The image forming apparatus 1 forms an image on paper. The paper includes the sheet S. The sheet S is for example plain paper, copy paper, recycled paper, thin paper, thick paper, glossy paper, or an overhead projector (OHP) sheet.

The image forming apparatus 1 includes a main body 200. The main body 200 includes an accommodation section 210, an image forming section 220, an opening and closing detection switch 230, and a conveyance path T1.

The accommodation section 210 accommodates a cassette. The cassette is disposed in a lower portion of the image forming apparatus 1. A plurality of sheets S is loadable in the cassette.

The image forming section 220 forms an image on a sheet S. Specifically, the image forming section 220 forms a toner image on a sheet S. The image forming section 220 is located downstream of the accommodation section 210 along the conveyance path T1. Specifically, the image forming section 220 has photosensitive drums 221, developing sections 222, a transfer section 223, and toner containers 224. The image forming section 220 has four photosensitive drums 221. The photosensitive drums 221 are arranged side-by-side in a horizontal direction. Each photosensitive drum 221 is irradiated with laser based on image data. As a result, an electrostatic latent image is formed on each photosensitive drum 221. The developing sections 222 supply toners to the photosensitive drums 221. The developing sections 222 are provided in one-to-one correspondence with the four photosensitive drums 221. Specifically, the developing sections 222 include a developing section 222 for supplying a yellow toner to the corresponding photosensitive drum 221, a developing section 222 for supplying a cyan toner to the corresponding photosensitive drum 221, a developing section 222 for supplying a magenta toner to the corresponding photosensitive drum 221, and a developing section 222 for supplying a black toner to the corresponding photosensitive drum 221. As a result of the developing sections 222 supplying the toners to the photosensitive drums 221, the electrostatic latent images are developed into toner images on the respective photosensitive drums 221. The toner images include a yellow toner image, a cyan toner image, a magenta toner image, and a black toner image. The transfer section 223 transfers the toner images from the respective photosensitive drums 221 onto a transfer belt such that the toner images are superimposed on one another, and then transfers the superimposed toner images onto the sheet S. The transfer belt is included in the transfer section 223 and rotates while in contact with the photosensitive drums 221. The toner containers 224 supply the toners of the respective colors to the developing sections 222. The toner containers 224 include a yellow toner container 224, a cyan toner container 224, a magenta toner container 224, and a black toner container 224. Since the toner containers 224 supply the toners to the developing sections 222, the developing sections 222 can supply the toners to the photosensitive drums 221.

The opening and closing detection switch 230 detects opening and closing of the second cover 12. The opening and closing detection switch 230 is an ON/OFF switch. The opening and closing detection switch 230 is provided on the main body 200. The opening and closing detection switch 230 is in an ON state while the opening and closing detection switch 230 is depressed. The opening and closing detection switch 230 is in an OFF state while the opening and closing detection switch 230 is not depressed. When the second cover 12 is closed, the second cover 12 depresses the opening and closing detection switch 230, and the opening and closing detection switch 230 switches into the ON state. While the opening and closing detection switch 230 is in the ON state, operation of the image forming apparatus 1 is enabled. When the second cover 12 is opened, the second cover 12 stops depressing the opening and closing detection switch 230, and the opening and closing detection switch 230 switches into the OFF state. While the opening and closing detection switch 230 is in the OFF state, operation of the image forming apparatus 1 is disabled. The opening and closing detection switch 230 allows the image forming apparatus 1 to be disabled when the second cover 12 is not properly closed. It is therefore possible to prevent a defect from occurring in the image forming apparatus 1 due to the second cover 12 being not properly closed.

The sheet S is conveyed along the conveyance path T1. The conveyance path T1 includes a sheet feed section and a sheet conveyance section. The sheet feed section feeds the sheet S to the sheet conveyance section. The sheet feed section is located downstream of the cassette. The sheet conveyance section includes a plurality of roller pairs arranged along the conveyance path T1. Each roller pair includes a drive roller and a driven roller. The drive roller is connected to a drive source such as an electric motor for example through a rotational shaft thereof. The driven roller is in pressed contact with the drive roller and is caused to rotate by force of friction against the drive roller. The driven roller also rotates in accompaniment to rotation of the drive roller with the sheet S therebetween.

The following describes an upper unit 100 of the image forming apparatus 1 with reference to FIGS. 1 and 2. The image forming apparatus 1 further includes the upper unit 100. The upper unit 100 is disposed in an upper portion of the main body 200. The upper unit 100 is located above the photosensitive drums 221 in the upper portion of the main body 200. The upper unit 100 includes the top panel 10, an operation section 101, a fixing section 110, an ejection section 120, and a conveyance path T2. The upper unit 100 may include any of the photosensitive drums 221, the developing sections 222, the transfer section 223, the toner containers 224, and the conveyance path T1 in the main body 200. For example, the upper unit 100 may include the conveyance path T1.

The operation section 101 has a display section and an input section. The display section includes a display. The display includes a liquid-crystal display (LCD) or an electroluminescence display (ELD) having a touch panel function. The display section may be a touch panel incorporating the input section. The input section receives user operation. The user operation for example includes an operation to configure various settings of the image forming apparatus 1. The operation section 101 is held on the third cover 15.

The fixing section 110 fixes the toner images to the sheet S. Specifically, after the toner images have been transferred onto the sheet S, the fixing section 110 applies heat and pressure to the sheet S to fix the toner images to the sheet S. The fixing section 110 is located downstream of the image forming section 220. After the toner images have been fixed to the sheet S, the ejection section 120 ejects the sheet S.

The sheet S is conveyed along the conveyance path T2. The conveyance path T2 is located downstream of the image forming section 220. The conveyance path T2 includes a sheet conveyance section. The sheet conveyance section includes a plurality of roller pairs arranged along the conveyance path T2. Each roller pair includes a drive roller and a driven roller. The drive roller is connected to a drive source such as an electric motor for example through a rotational shaft thereof. The driven roller is in pressed contact with the drive roller and is caused to rotate by force of friction against the drive roller. The driven roller also rotates in accompaniment to rotation of the drive roller with the sheet S therebetween. The sheet conveyance section of the conveyance path T2 can convey the sheet S from the fixing section 110 to the ejection section 120 along the conveyance path T2. The conveyance path T2 connects to the conveyance path T1. Thus, the sheet S conveyed from the accommodation section 210 to the conveyance path T2 along the conveyance path T1 is conveyed to the ejection section 120 by the conveyance path T2.

Figure 3:
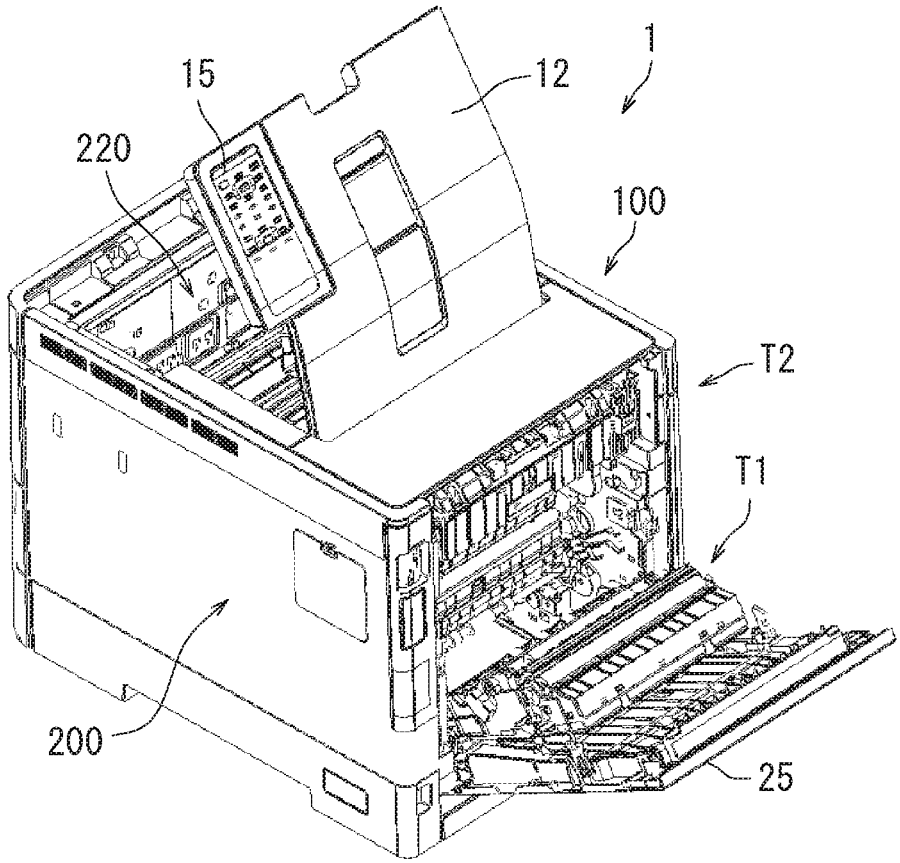
FIG. 3 is a diagram illustrating the image forming apparatus in a state in which the inside thereof is exposed.

The following describes the image forming apparatus 1 in a state in which the inside thereof is exposed with reference to FIGS. 2 and 3. FIG. 3 illustrates the image forming apparatus 1 in the state in which the inside thereof is exposed. In FIG. 3, the top of the image forming apparatus 1 is open. In FIG. 3, the back of the image forming apparatus 1 is also open.

As illustrated in FIG. 2, the second cover 12 includes a rotational shaft X. The rotational shaft X is fixed to the upper unit 100. The second cover 12 is pivoted about the rotational shaft X. The second cover 12 is pivoted about the rotational shaft X to bring the image forming apparatus 1 to an open state in which the top of the image forming apparatus 1 is open. The second cover 12 is pivoted about the rotational shaft X also to bring the image forming apparatus 1 to a closed state in which the top of the image forming apparatus 1 is closed.

To open the top of the image forming apparatus 1, the second cover 12 is pivoted about the rotational shaft X. Specifically, the second cover 12 is pivoted in a direction away from the main body 200. As a result, the top of the image forming apparatus 1 is opened and the inside of the image forming apparatus 1 is exposed. When the top of the image forming apparatus 1 is open, the toner containers 224 in the main body 200 are exposed.

When the top of the image forming apparatus 1 is open, an upper portion of the inside of the main body 200 is accessible. The user opens the second cover 12 to perform maintenance of the apparatus. The maintenance of the apparatus is for example replacement of the image forming section 220. Specifically, the user can remove the photosensitive drums 221 from the main body 200 by pivoting the second cover 12, and thus opening the top of the image forming apparatus 1. In order to remove the photosensitive drums 221 from the main body 200, the user removes the toner containers 224. After the toner containers 224 have been removed from the main body 200, the transfer section 223 can be removed from the main body 200. After the transfer section 223 has been removed from the main body 200, the photosensitive drums 221 can be removed from the main body 200.

To close the top of the image forming apparatus 1, the second cover 12 is also pivoted about the rotational shaft X. Specifically, the second cover 12 is pivoted in a direction toward the main body 200. As a result, the top of the image forming apparatus 1 is closed and the inside of the image forming apparatus 1 is covered. When the top of the image forming apparatus 1 is closed, the second cover 12 allows the sheet S ejected by the ejection section 120 to be placed on the upper surface of the second cover 12.

When the image forming apparatus 1 is closed, access to the inside of the main body 200 can be prevented. For example, access to the inside of the main body 200 by the user during operation of the image forming apparatus 1 can be prevented.

The third cover 15 moves in accompaniment to the pivoting of the second cover 12. The operation section 101 also moves in accompaniment to the movement of the third cover 15.

As illustrated in FIG. 2, the back cover 25 includes a rotational shaft Y. The rotational shaft Y is fixed to the main body 200. The back cover 25 is pivoted about the rotational shaft Y. The back cover 25 is pivoted about the rotational shaft Y to bring the image forming apparatus 1 to an open state in which the back of the image forming apparatus 1 is open. The back cover 25 is pivoted about the rotational shaft Y also to bring the image forming apparatus 1 to a closed state in which the back of the image forming apparatus 1 is closed.

To close the back of the image forming apparatus 1, the back cover 25 is pivoted about the rotational shaft Y in a direction away from the main body 200. As a result, the back of the image forming apparatus 1 is opened and the inside of the image forming apparatus 1 is exposed. When the back of the image forming apparatus 1 is open, the conveyance path T2 and the conveyance path T1 of the upper unit 100 in the main body 200 are exposed.

When the back of the image forming apparatus 1 is open, the inside of the main body 200 is accessible. The user opens the back cover 25 to perform maintenance of the apparatus. The maintenance of the apparatus is for example jam removal. Specifically, the user can remove a sheet S stuck in the conveyance path T1 from the main body 200 by pivoting the back cover 25, and thus opening the back of the image forming apparatus 1. The user can also remove a sheet S stuck in the conveyance path T2 from the main body 200.

To close the back of the image forming apparatus 1, the back cover 25 is pivoted about the rotational shaft Y in a direction toward the main body 200. As a result, the back of the image forming apparatus 1 is closed and the inside of the image forming apparatus 1 is covered. When the image forming apparatus 1 is closed, the back cover 25 presses the upper unit 100 from behind.

When the back of the image forming apparatus 1 is closed, access to the inside of the main body 200 can be prevented. For example, access to the inside of the main body 200 during operation of the image forming apparatus 1 can be prevented.

Figure 4:
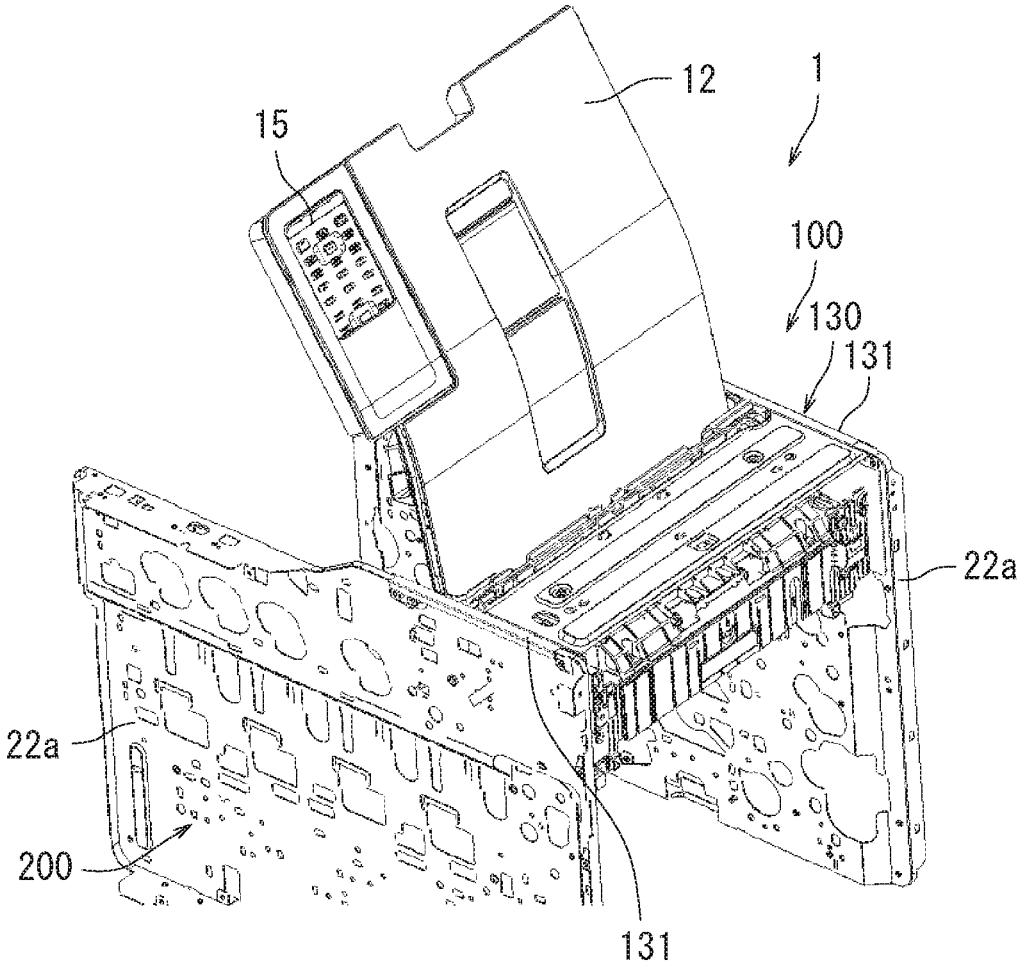
FIG. 4 is a diagram illustrating the image forming apparatus without exterior members.
Figure 5:
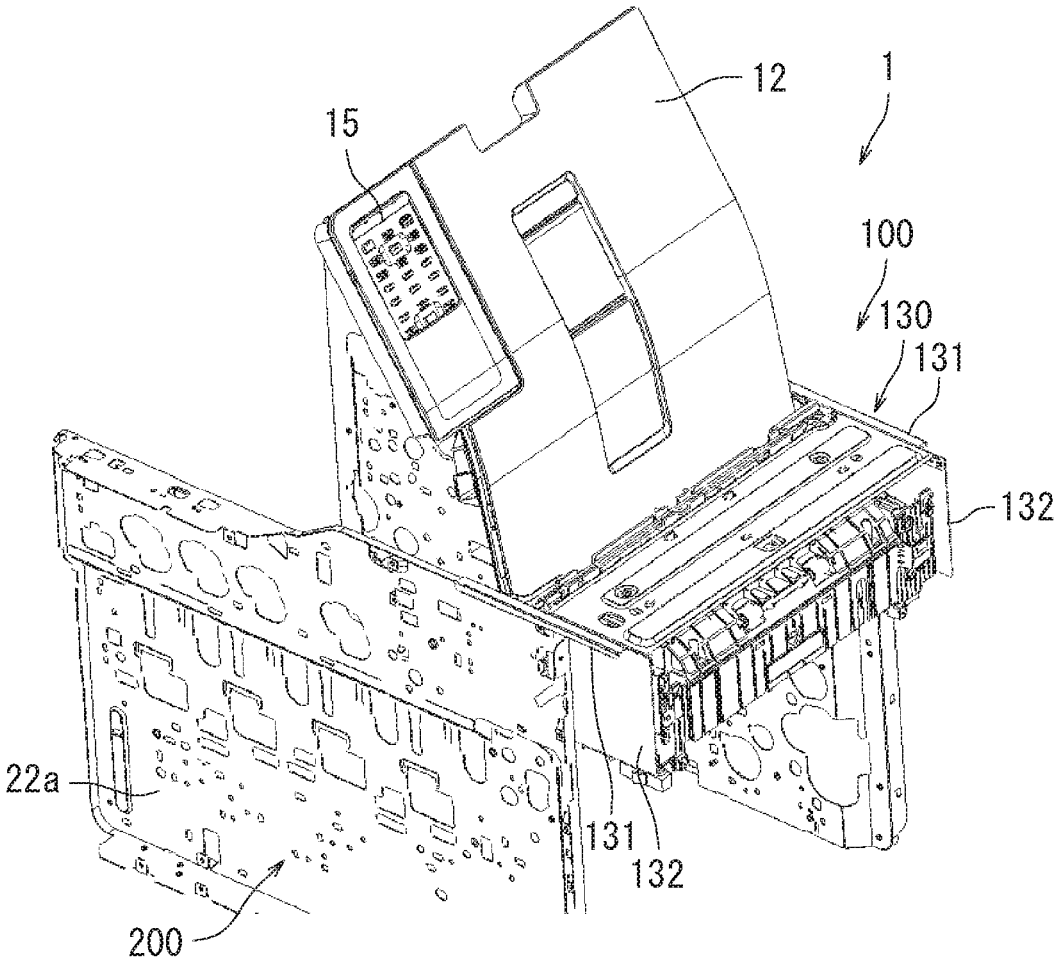
FIG. 5 is a diagram illustrating the image forming apparatus without the exterior members.

The following describes a moving mechanism 130 with reference to FIGS. 2 to 5. FIG. 4 illustrates the image forming apparatus 1 without the exterior members. FIG. 5 illustrates the image forming apparatus 1 without the exterior members. FIGS. 4 and 5 illustrate the main body 200 of the image forming apparatus 1 from which the exterior members, the accommodation section 210, the image forming section 220, and the conveyance path T1 illustrated in FIG. 2 have been removed. As illustrated in FIGS. 4 and 5, the main body 200 includes a pair of frames 22*a*. The frames 22*a* are covered by the side panels 22. The frames 22*a* enclose unillustrated components such as the accommodation section 210, the image forming section 220, and the conveyance path T1. The frames 22*a* also enclose the upper unit 100 as illustrated in FIG. 3.

The moving mechanism 130 moves the upper unit 100. Specifically, the moving mechanism 130 moves the upper unit 100 to a first position and to a second position. More specifically, the moving mechanism 130 moves the upper unit 100 to a position where the upper unit 100 is enclosed within the frames 22*a* as illustrated in FIG. 4. The moving mechanism 130 also moves the upper unit 100 to a position where a portion of the upper unit 100 protrudes from the frames 22*a* as illustrated in FIG. 5. The moving mechanism 130 includes guide rails 131 and attachment sections 132.

The guide rails 131 guide the upper unit 100. The guide rails 131 are disposed at upper ends of the frames 22*a*. The guide rails 131 are recessed. The ends of the frames are disposed in the recessed spaces. The guide rails 131 cover the upper ends of the frames 22*a*. As a result, the guide rails 131 are supported on the upper ends of the frames 22*a*.

The guide rails 131 guide the upper unit 100 to the first position and to the second position. The first position of the upper unit 100 is above a position of the image forming section 220 in the upper portion of the main body 200. An example of the first position is a position of the upper unit 100 illustrated in FIG. 4. Specifically, the first position is above the position of the image forming section 220 in the upper portion of the main body 200 and overlaps the image forming section 220. When in the position illustrated in FIG. 4, the upper unit 100 is enclosed within the frames 22*a* of the main body 200 and is located above the photosensitive drums 221 illustrated in FIG. 2. The second position of the upper unit 100 is in the upper portion of the main body 200 but is not necessarily above the position of the image forming section 220. The second position is in the upper portion of the main body 200 and is different from the first position. An example of the second position is a position of the upper unit 100 illustrated in FIG. 5. Specifically, the second position is above the position of the image forming section 220 in the upper portion of the main body 200 and does not overlap the image forming section 220. When in the position illustrated in FIG. 5, the upper unit 100 is not necessarily located above the photosensitive drums 221 illustrated in FIG. 2 and a portion of the upper unit 100 protrudes from the frames 22*a*.

The attachment sections 132 attach the respective guide rails 131 to the upper unit 100. Specifically, each attachment section 132 attaches the corresponding guide rail 131 to a side surface of the upper unit 100. Each attachment section 132 extends from an end of the corresponding guide rail 131. Each attachment section 132 and the corresponding guide rail 131 are formed as a single piece. Thus, the guide rails 131 can support the upper unit 100 movably relative to the frames 22*a*.

Figure 6:
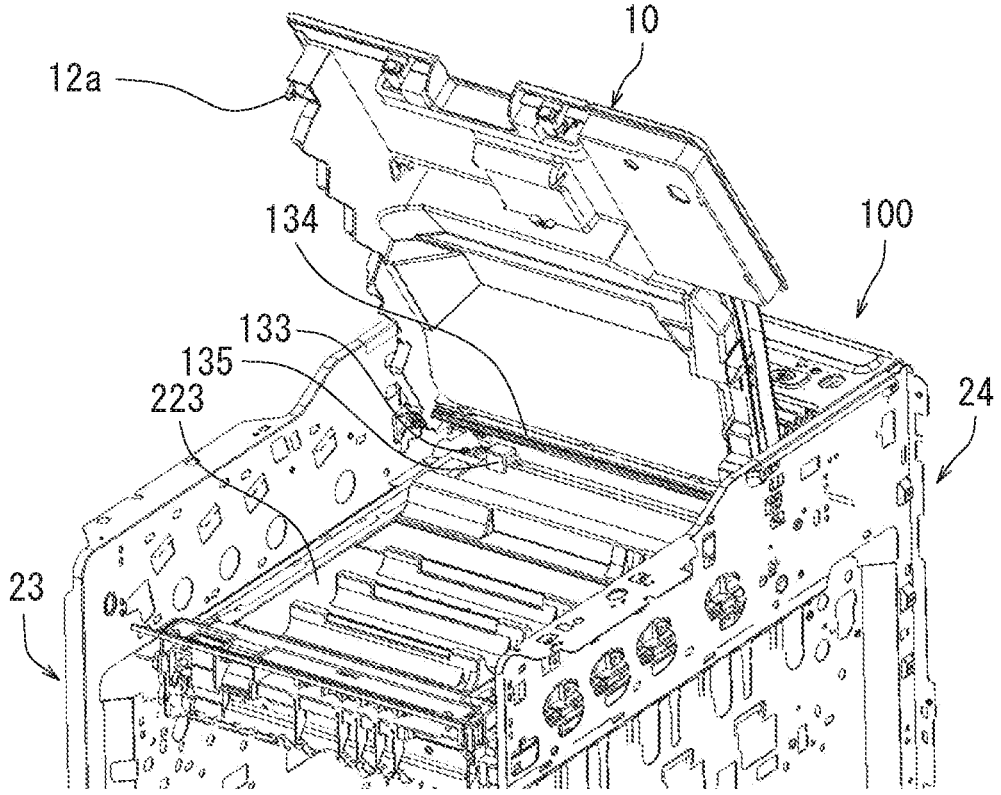
FIG. 6 is a diagram illustrating the image forming apparatus in a state in which the top thereof is open.

The following describes lock sections 133 of the moving mechanism 130 with reference to FIG. 6. FIG. 6 is a diagram illustrating the image forming apparatus 1 in a state in which the top thereof is open. The moving mechanism 130 further includes the lock sections 133. The lock sections 133 fix the upper unit 100 in the first position. The moving mechanism 130 includes a plurality of lock sections 133. Specifically, the moving mechanism 130 includes two lock sections 133.

Each lock section 133 includes an engagement protrusion 134 and a protrusion holder 135. The engagement protrusions 134 are provided in a lower portion of the upper unit 100. The engagement protrusions 134 protrude toward the front panel 23. Each engagement protrusion 134 has an extension extending toward the top panel 10. The extensions come in contact with the respective protrusion holder 135. Each engagement protrusion 134 is tapered from the extension toward a distal end of the engagement protrusion 134. The distal end of each engagement protrusion 134 is therefore sharp.

The protrusion holders 135 are provided in the main body 200. Specifically, the protrusion holders 135 are provided above the transfer section 223. The protrusion holders 135 protrude toward the back panel 24. Each protrusion holder 135 has an extension extending toward the transfer section 223. The extensions of the protrusion holders 135 come in contact with the respective engagement protrusions 134. Thus, the extensions of the protrusion holders 135 and the extensions of the engagement protrusions 134 come in contact with each other. Each protrusion holder 135 and the corresponding engagement protrusion 134 engage with each other through the extension of the protrusion holder 135 and the extension of the engagement protrusion 134 coming in contact with each other. Thus, the lock sections 133 restrict the upper unit 100 from moving toward the back panel 24 relative to the main body 200, fixing the upper unit 100 in the first position.

The upper unit 100 becomes movable through the engagement protrusions 134 and the protrusion holders 135 disengaging from each other. As a result, the upper unit 100 can be moved from the first position to the second position.

Each engagement protrusion 134 and the corresponding protrusion holder 135 can for example disengage from each other through a configuration in which a push button provided on the first cover 11 is depressed to press a linking member, thereby causing the engagement protrusion 134 to elastically deform downward and disengage from the protrusion holder 135. When the upper unit 100 in this configuration is moved from the second position to the first position, each engagement protrusion 134 elastically deforms downward upon a sloping surface thereof coming in contact with the extension of the corresponding protrusion holder 135. Once the upper unit 100 reaches the first position, the engagement protrusions 134 engage with the protrusion holders 135 by action of their elastic return. The engagement protrusions 134 and the protrusion holders 135 may disengage from each other through another configuration. For example, the engagement protrusions 134 may be linked to the second cover 12 and move downward to disengage from the protrusion holders 135 as the second cover 12 is pivoted until the top of the image forming apparatus 1 is open as illustrated in for example FIG. 3. In this configuration, the engagement protrusions 134 move upward to engage with the protrusion holders 135 as the second cover 12 opening the top of the image forming apparatus 1 is pivoted in a direction for closing the top of the image forming apparatus 1 with the upper unit 100 in the first position. As a result, the upper unit 100 is fixed in the first position.

Figure 7:
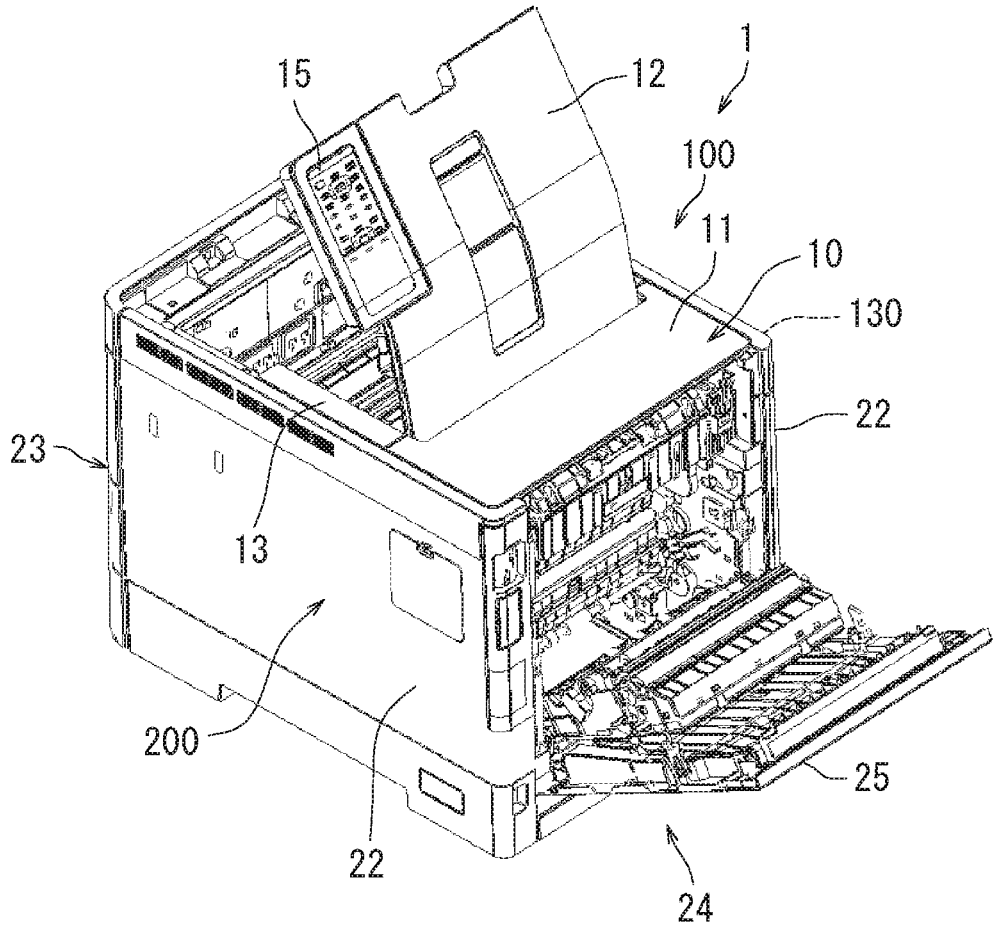
FIG. 7 is a diagram illustrating an upper unit in a first position.
Figure 8:
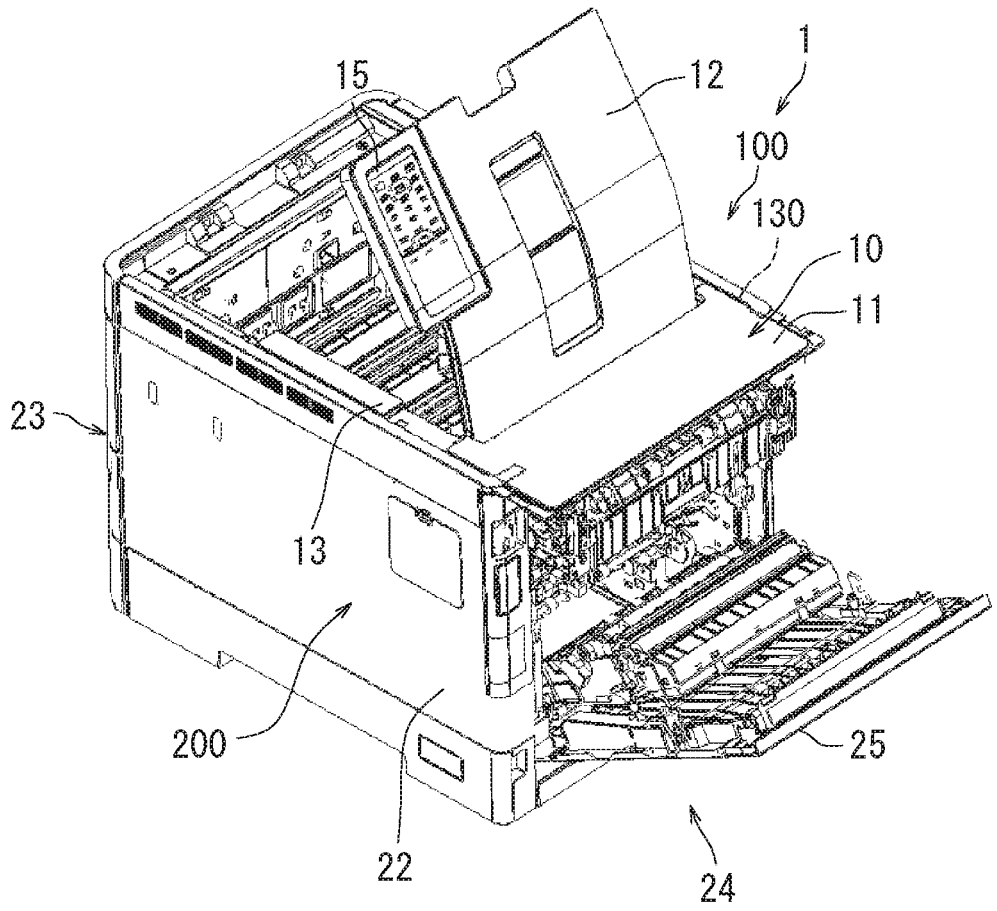
FIG. 8 is a diagram illustrating the upper unit in a second position.

The following describes movement of the upper unit 100 to the first position and to the second position with reference to FIGS. 7 and 8. FIG. 7 illustrates the upper unit 100 in the first position. FIG. 8 illustrates the upper unit 100 in the second position.

To move the upper unit 100, the second cover 12 is pivoted to open the top of the image forming apparatus 1. The back cover 25 is also pivoted to open the back of the image forming apparatus 1. Furthermore, the engagement protrusion 134 and the protrusion holder 135 of each lock section 133 of the moving mechanism 130 are caused to disengage from each other. As a result, the moving mechanism 130 can move the upper unit 100.

To move the upper unit 100 to the second position, the moving mechanism 130 moves the upper unit 100 from a position of the upper unit 100 illustrated in FIG. 7 to a position of the upper unit 100 illustrated in FIG. 8. Specifically, the moving mechanism 130 moves the upper unit 100 in a direction away from the front panel 23. As a result of the upper unit 10) moving in the direction away from the front panel 23, an upper space in the image forming apparatus 1 increases. This makes it easy to access the inside of the image forming apparatus 1 from above. Since the upper space in the image forming apparatus 1 increases, maintenance requiring attachment or detachment of a component of the image forming apparatus can be performed more efficiently.

The upper unit 100 is not located right above the image forming section 220 when the upper unit 100 is in the second position. The image forming section 220 can therefore be pulled straight up. Such a configuration eliminates the need to pull angularly up the image forming section 220 to circumvent the upper unit 100 right above the image forming section 220. As a result, the image forming section 220 can be prevented from interfering with another component of the image forming apparatus 1. For example, when the photosensitive drums 221 are to be replaced, the photosensitive drums 221 can be pulled right up as long as the upper unit 100 is in the second position. Thus, the above-described configuration eliminates the need to pull angularly up the image forming section 220 to circumvent the upper unit 100 right above the image forming section 220. As a result, the photosensitive drums 221 can be prevented from interfering with another component of the image forming apparatus 1.

The upper unit 100 can be moved to the first position by moving the upper unit 100 toward the front panel 23. As a result, a space behind the image forming apparatus 1 increases. This makes it easy to access the inside of the image forming apparatus 1 from behind. That is, jam removal is facilitated. Since the space behind the image forming apparatus 1 increases, maintenance of the apparatus can be performed more efficiently.

Figure 9:
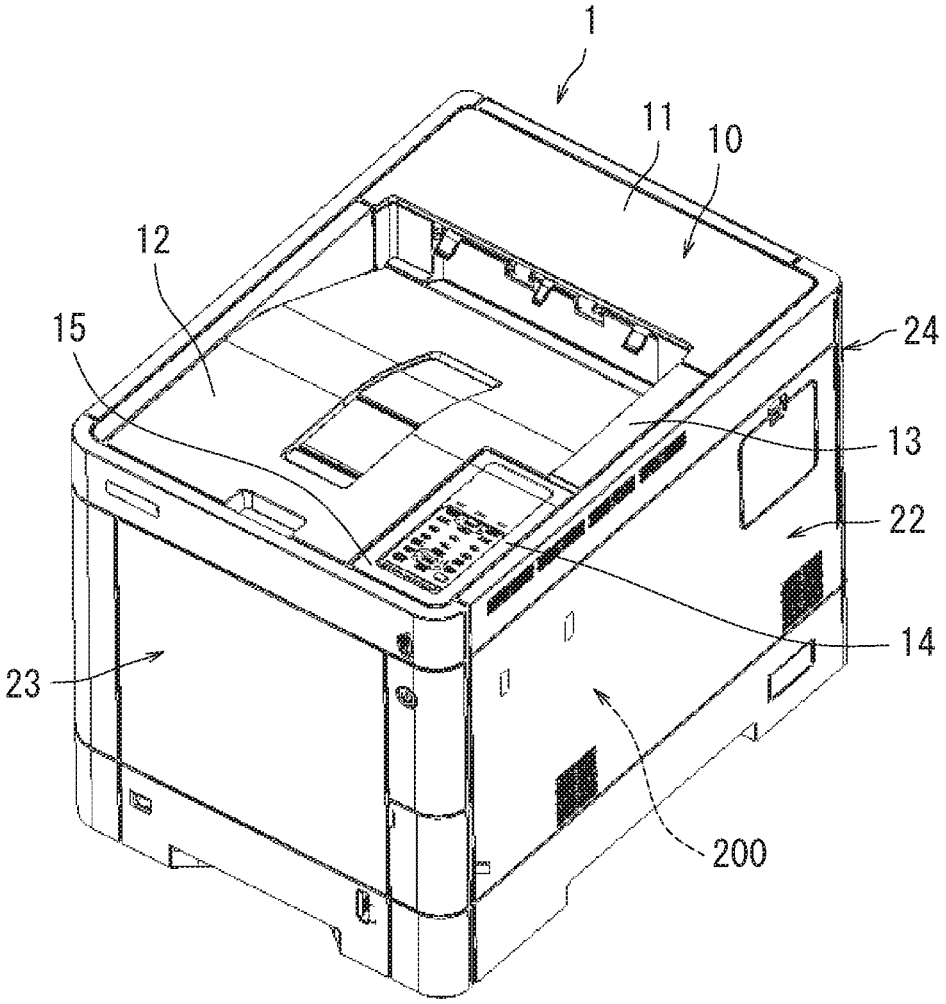
FIG. 9 is a diagram illustrating a restriction section.

The following describes a restriction section 13 with reference to FIGS. 6 to 9. FIG. 9 is a diagram illustrating the restriction section 13. The image forming apparatus 1 further includes the restriction section 13. Specifically, the top panel 10 further includes the restriction section 13. In FIG. 9, the top of the image forming apparatus 1 is closed.

The restriction section 13 closes a top portion of the image forming apparatus 1. The top portion closed by the restriction section 13 is different from the top portion of the image forming apparatus 1 closed by the first cover 11. The top portion closed by the restriction section 13 is also different from the top portion of the image forming apparatus 1 closed by the second cover 12. The top portion closed by the restriction section 13 is also different from the top portion of the image forming apparatus 1 closed by the third cover 15.

The restriction section 13 is located next to the first cover 11. The restriction section 13 is located next to the second cover 12. The second cover 12 includes a depressing section 12*a* protruding toward the main body 200. The depressing section 12*a* depresses the opening and closing detection switch 230 on the main body 200. The restriction section 13 is located next to the third cover 15. The restriction section 13 is surrounded by the first cover 11, the second cover 12, and the third cover 15. The restriction section 13 is located in the vicinity of one of the side panels 22.

The restriction section 13 is fixed to the upper portion of the main body 200. That is, the restriction section 13 does not move in accompaniment to the pivoting of the second cover 12.

One end of the restriction section 13 is located adjacent to the back panel 24. The one end of the restriction section 13 is oriented toward the first cover 11. The one end of the restriction section 13 may be in contact with the first cover 11. An opposite end of the restriction section 13 is located adjacent to the front panel 23. The opposite end of the restriction section 13 is oriented toward the third cover 15. The opposite end of the restriction section 13 may be in contact with the third cover 15.

When the upper unit 100 is in the first position as illustrated in FIG. 7, the restriction section 13 and the first cover 11 are in proximity to each other. Specifically, the one end of the restriction section 13 is in contact with the first cover 11. When the upper unit 100 is in the second position as illustrated in FIG. 8, the first cover 11 is separate from the restriction section 13. Specifically, the one end of the restriction section 13 is not in contact with the first cover 11.

The restriction section 13 restricts movement of the upper unit 100. Specifically, the restriction section 13 restricts movement of the upper unit 100 such that the upper unit 100 is stationary in the first position. More specifically, the one end of the restriction section 13 in contact with the first cover 11 restricts the upper unit 100 from moving toward the front panel 23 beyond the restriction section 13. As a result, the upper unit 100 can be restricted from moving from the first position toward the front panel 23. Since the upper unit 100 is restricted from moving toward the front panel 23, the upper unit 100 can be restricted from interfering with the image forming section 220.

The restriction section 13 also restricts the second cover 12 from being closed while the upper unit 100 is not in the first position. When the upper unit 100 is not in the first position, the third cover 15 interferes with the restriction section 13 during the course of trying to close the second cover 12, preventing the second cover 12 from being completely closed. Since the second cover 12 cannot be closed, the opening and closing detection switch 230 is not depressed. As a result, operation of the image forming apparatus 1 is disabled. Thus, when the upper unit 100 is not in the first position, the restriction section 13 prevents the second cover 12 from being closed, and operation of the image forming apparatus 1 is disabled.

The restriction section 13 also restricts the upper unit 100 from moving to the second position while the top of the image forming apparatus 1 is closed as illustrated in FIG. 9. Specifically, the opposite end of the restriction section 13 in contact with the third cover 15 restricts the upper unit 100 from moving to the second position. For example, the upper unit 100 can be restricted from moving to the second position while the back of the image forming apparatus 1 is open with the back cover 25 pivoted and maintenance of the apparatus is being performed. As a result, maintenance of the apparatus can be performed more efficiently.

Through the above, an embodiment of the present disclosure has been described with reference to the drawings (FIGS. 1 to 9). However, the present disclosure is not limited to the above embodiment and may be implemented in various different forms that do not deviate from the essence of the present disclosure. Also, a plurality of elements of configuration in a plurality of embodiments can be combined as appropriate to form various disclosures. For example, some of the elements of configuration included in the embodiments may be omitted. For another example, some of the elements of configuration from different embodiments may be combined as appropriate. The drawings schematically illustrate elements of configuration in order to facilitate understanding and properties of the elements of configuration illustrated in the drawings, such as thickness, length, number, and spacing thereof, may differ from actual properties thereof in order to facilitate preparation of the drawings. Furthermore, properties of the elements of configuration described in the above embodiment, such as rate, material, shape, and dimensions thereof, are merely examples and are not intended as specific limitations, and may be altered in various ways within the scope not departing from the configuration of the present disclosure.

What is claimed is:

1. An image forming apparatus comprising:

a main body including an image forming section configured to form an image on paper;

an upper unit disposed in an upper portion of the main body;

a rotational shaft supported movably in a horizontal direction; and a moving mechanism configured to move the upper unit together with the rotational shaft to a first position and to a second position in the horizontal direction, wherein the image forming section includes:

a plurality of photosensitive drums arranged in the horizontal direction;

a plurality of developing sections each configured to supply toner to a corresponding one of the photosensitive drums;

a transfer section including a transfer belt and configured to transfer toner images formed on the respective photosensitive drums to the transfer belt, the transfer belt rotating while in contact with a circumferential surface of each of the photosensitive drums; and a plurality of containers arranged in the horizontal direction above the transfer section and each configured to supply toner to a corresponding one of the developing sections, the upper unit includes:

a fixing section configured to fix the toner images to a sheet with the toner images transferred by the transfer section thereon;

a cover mounted pivotally about the rotational shaft and that is configured to be positioned at a closing position to bring top of the main body to an open state and be positioned at an open position to allow access to the top of the main body;

an ejection section configured to eject the sheet with the toner images fixed thereto by the fixing section onto an upper surface of the cover; and a conveyance path located downstream of the image forming section and through which the sheet is conveyed from the fixing section to the ejection section, the first position of the upper unit is a position of the upper unit where the upper unit and the rotational shaft are located at a location above the image forming section in the upper portion of the main body, and the second position of the upper unit is a position of the upper section where the upper unit and the rotational shaft are located at a location in the upper portion of the main body that is different from the location above the image forming section.

2. The image forming apparatus according to claim 1, wherein the main body further includes frames enclosing the image forming section, and the moving mechanism includes a guide rail supporting the upper unit movably relative to the frames.

3. The image forming apparatus according to claim 2, wherein the guide rail guides the upper unit to the first position and to the second position, the upper unit is enclosed within the frames when the upper unit is in the first position, and a portion of the upper unit protrudes from the frames when the upper unit is in the second position.

4. The image forming apparatus according to claim 1, wherein the moving mechanism further includes a lock section configured to fix the upper unit in the first position.

5. The image forming apparatus according to claim 1, further comprising restriction section configured to restrict movement of the upper unit.

6. The image forming apparatus according to claim 4, wherein the lock section moves in association with opening and closing of the cover, when the cover moves to the closing position, the lock section causes the upper unit to be stationary in the first position, and when the cover moves to the open position, the lock section allows the upper unit to move to the second position.

* * * * *